United States Patent [19]

Deaett

[11] Patent Number: 5,005,204

[45] Date of Patent: Apr. 2, 1991

[54] DIGITAL SOUND SYNTHESIZER AND METHOD

[75] Inventor: Michael A. Deaett, N. Kingstown, R.I.

[73] Assignee: Raytheon Company, Lexington, Mass.

[21] Appl. No.: 332,414

[22] Filed: Mar. 30, 1989

Related U.S. Application Data

[63] Continuation-in-part of Ser. No. 756,220, Jul. 18, 1985, abandoned.

[51] Int. Cl.[5] ..... G10L 5/00

[52] U.S. Cl. ..... 381/51; 364/513.5

[58] Field of Search ..... 381/36–41, 381/51–53; 364/513.5

[56] References Cited

U.S. PATENT DOCUMENTS 3,158,685 11/1964 Gerstman ..... 381/52
4,344,148 8/1982 Brantingham ..... 364/724

FOREIGN PATENT DOCUMENTS 0209336 1/1987 European Pat. Off. .
2510288 7/1981 France .
2103908 A 7/1982 United Kingdom .

OTHER PUBLICATIONS

Ozeki, Kazuhiko, "A Speech Analysis and Synthesis System by Linear Prediction for Pitch controlled Speech Compilation Experiments", NHK Laboratories Note, Ser. No. 209, Feb. 1977, pp. 1, 3–12.

*Primary Examiner*—Emanuel S. Kemeny
*Attorney, Agent, or Firm*—Denis G. Maloney

[57] ABSTRACT

This invention utilizes a time-varying recursive filter where the multipliers following successive delay elements of the filter have sets of normalized covariance matrix coefficients which are stored and which have been obtained from the normalized autocorrelation coefficients for each of a plurality of time frames of the sampled transient signal which is to be synthesized from the stored coefficients. The normalization constant during a frame is also applied as a scale factor to the recursive filter. The input of the filter is a pseudo-random noise generator signal applied to the recursive filter at the sample rate. A plurality of successive time frames of operation of the recursive filter and with a set of coefficients for each time frame provides the entire synthesized transient signal. An analog and digital implementation of the synthesizer are described.

10 Claims, 4 Drawing Sheets

DIGITAL SOUND SYNTHESIZER AND METHOD

This application is a continuation-in-part of application Ser. No. 756,220 filed July 18, 1985.

BACKGROUND OF THE INVENTION

This invention relates to the synthesis of audio signals from stored digital data and more particularly to a synthesizer in which the stored data are sets of the coefficients of a recursive filter and where each set is applied to the filter for a fixed time period, the periods totaling the duration of the synthesized audio signal.

Acoustic trainers are typically required to produce signatures characteristic of signals received from sources in a real ocean environment. Traditionally, the broadband and harmonic spectral content of targets and the broadband content of background noise have been emphasized for replication. Recently, active echoes and reverberation have been added to the trainer repertoire. An additional component of the acoustic environment which is required for purposeful training is the set of transient signatures. These include occasional and also continuous biologic emissions, hatch openings and closings, ice fractures in the arctic environment, undersea seismic disturbances, and the noise of submerged wrecks moving with currents—just to name a few. The synthesis of these transients has typically resided in an instructor controlled analog tape recorder. The disadvantage of this approach is the large number of tapes required and/or the problem of and time required for locating a particular sound of a number of sounds on a long tape. In addition, the control of the tape recorder and its connection are cumbersome.

It is therefore an object of this invention to provide a computer controlled synthesis system providing transient audio signals. It is also an object of this invention to provide a system which is not cumbersome and is easy to use in the selection of different stored transient sounds. It is a further object of this invention to provide a digital synthesizer with denser packaging (smaller volume) for storing a large repertoire of audio sound signals. It is a still further object to produce a synthesizer which is more reliable than the analog synthesizer of the prior art.

It is a feature of this invention that the method of synthesis utilizes linear prediction coding techniques to derive time-varying-filter coefficients. These coefficients are stored in digital form and are used to program a recursive filter which is driven by white noise. The resulting signatures are then an inherent part of the trainer and are generated under complete computer control.

SUMMARY OF THE INVENTION

The aforementioned problems are overcome and other objects and advantages of this invention are provided by a system which approximates the desired transient signal by the storage of sets of coefficients of a recursive digital filter, which coefficients are updated periodically thereby resulting in an output from the recursive filter which is a close approximation of the actual transient signal. It is assumed that an autoregressive model will provide an adequate description of the desired transient signal. The signal which is desired to be synthesized is most easily obtained from a recording of the signal which is later to be synthesized. Because the spectral content of the transient signal is time varying, the auto-regressive model is nonstationary and must be updated periodically. Therefore, the transient signal is synthesized by considering the signal to be comprised of a serial sequence of blocks of the signal. Each block of the signal has its amplitude sampled to provide 1024 samples of digital data. The autocorrelation function of the 1024 amplitude samples provides the 12 most significant autocorrelation values and a gain value which is obtained through the normalization of the autocorrelation values. By establishing an equation relating the samples of the actual signal and subtracting therefrom signals which are generated by the recursive filter having as many coefficients as sample points of the actual signal. Multiplying the equation in order to obtain the autocorrelation function of the actual signal produces a series of equations from which the unknown filter coefficients are obtained. The system of equations is solved for each block of data and the filter coefficients are stored. Through the synthesizer signature the coefficients are periodically updated in real-time by a control processor. The coefficients are recovered from memory in real-time and provided to the recursive filter circuitry whose output is provided to a digital to analog converter to produce audible sound replicating the original transient signal.

BRIEF DESCRIPTION OF THE DRAWINGS

The aforementioned aspects and other features, objects and advantages of the method and apparatus of this invention will be apparent from the following detailed description taken in conjunction with the accompanying drawings wherein.

DESCRIPTION OF THE PREFERRED EMBODIMENT

Figure 1:
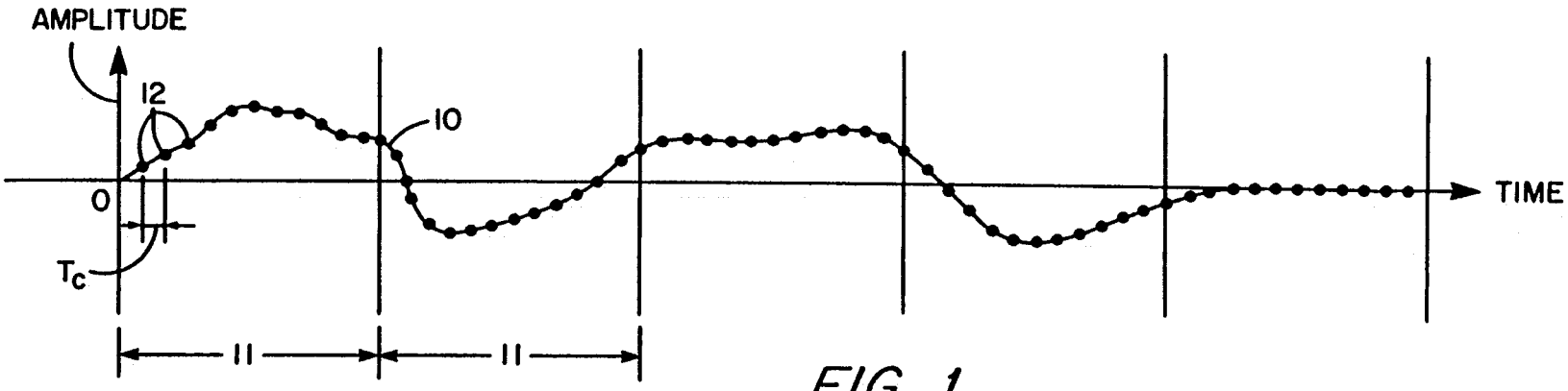
FIG. 1 shows the waveform of the original transient audio signal which is reproduced by the synthesizer of this invention.

The transient analog signal 10 of FIG. 1 which is to be simulated by the apparatus of this invention is operated upon by first partitioning the analog signal into a sequence of frames 11. The time duration of each frame is determined by examining the power spectral characteristics of the signal over a multiple of frame durations and then choosing the maximum duration over which those spectral characteristics are essentially constant. The sampled analog signature to be synthesized is iteratively analyzed and evaluated until an acceptable set filter coefficients yielding a suitable audio sound replication of the original analog signal is achieved. The greater the frequency extent of the power distribution, the shorter is the time period for that frame. The signal within each frame is then periodically sampled at a rate $T_c$ exceeding the Nyquist rate and stored in digital form. The set of samples 12 which is stored for each signal frame is a block of digital data. One block of data results for each signal frame. The number of sample points per block is determined by the frame duration and by the highest frequency contained in the data signal waveform which is to be synthesized. At least two and preferably four data points are obtained within a signal frame for the highest frequency component within that frame The sample data points contained within each block are autocorrelated and a selected number of the autocorrelation coefficients are determined. The number of autocorrelations values which are used is equal to the least number required to reduce the autocorrelation coefficient recursive prediction residual to an acceptable fraction of the zero lag autocorrelation value. An acceptable fraction is commonly 0.01. The autocorrelation values are normalized by a factor R which provide unity value of the autocorrelation coefficient at zero displacement. For the waveforms and block times utilized in embodiments of this invention, it is found that twelve autocorrelation coefficients are adequate to produce synthesized audio signals which are indistinguishable from the original signal from which the autocorrelation functions were obtained. The autocorrelation function coefficients have been designated by the letters $a_o$, $a_1$, . . . $a_m$ with the subscript indicating the relative lag displacement of the autocorrelated data blocks. The unity value coefficient $a_o$ is the normalized autocorrelation coefficient at zero relative displacement.

Figure 2:
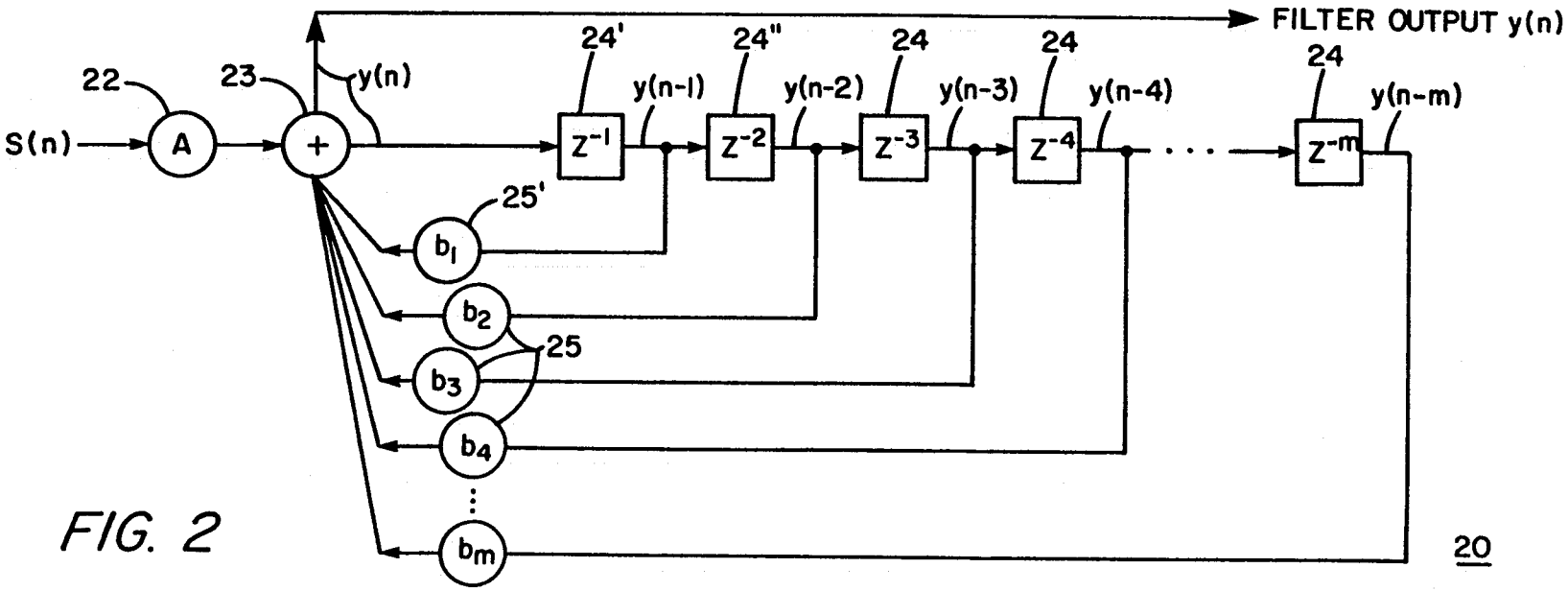
FIG. 2 shows a circuit diagram of a time-varying recursive filter.

The covariance matrix is next employed to determine the values for the multiplication factors "b" applied to the output of each of the delay units of the recursive filter as shown in FIG. 2. The covariance matrix is given below where "a" with subscripts are the normalized autocorrelation coefficient values. "b" with subscripts are the covariance matrix coefficients obtained from the covariance matrix and are the multiplying factors which are applied to the multipliers of the recursive filter in addition to the gain factor A. The covariance matrix provides the solution to the Yule-Walker equations using Levinson recursion to provide the values of "b" from the values "a".

$$\begin{bmatrix} a_0 & a_1 & \dots & a_{m-1} \\ a_1 & a_0 & \dots & . \\ . & . & & . \\ . & . & & . \\ . & . & & . \\ a_{m-1} & & & a_0 \end{bmatrix} \cdot \begin{bmatrix} b_1 \\ b_2 \\ . \\ . \\ . \\ b_m \end{bmatrix} = \begin{bmatrix} a_1 \\ a_2 \\ . \\ . \\ . \\ a_m \end{bmatrix};$$

$$a_0 = 1$$

$$m = \text{number of coefficients}$$

$$A^2 = R\left(1 + \sum_{k=1}^{m} a_k \cdot b_k\right)$$

Figure 1A:
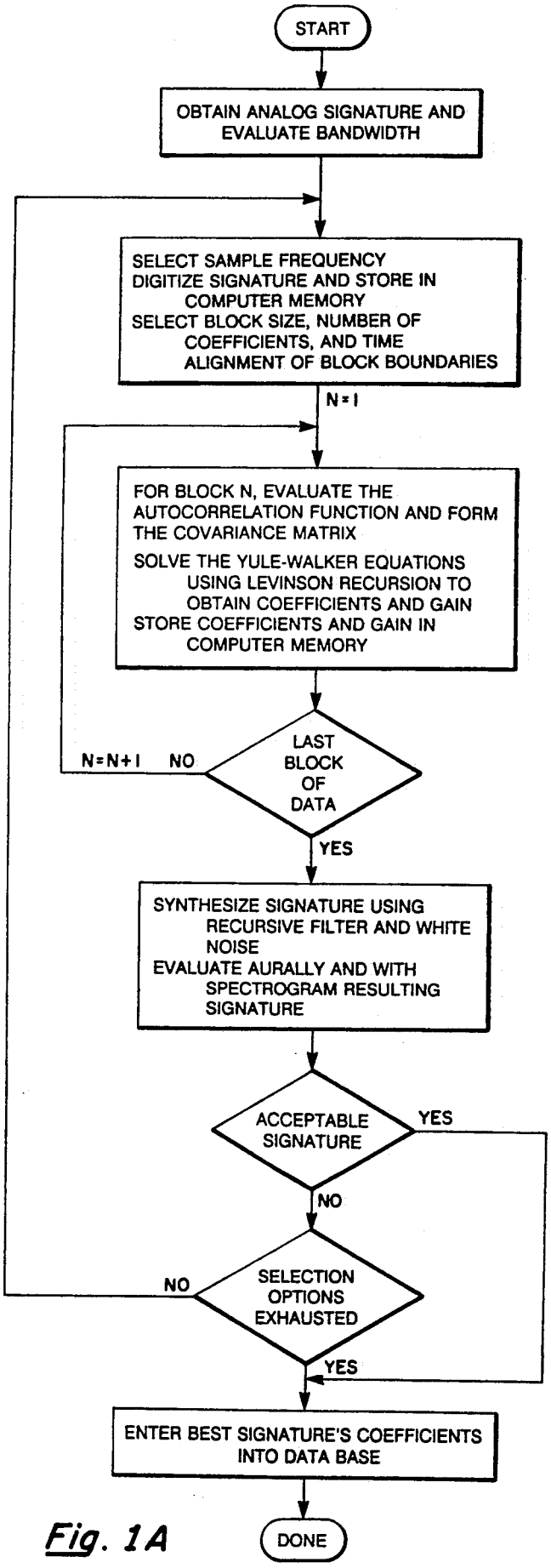
FIG. 1A is a flow diagram showing the iterative process for selection of filter coefficients.

The transient and biologic signatures are generated by feeding "white" (uncorrelated) noise samples S(n) through a time-varying recursive digital filter. The transfer function of this filter, G(Z), is given as $$G(Z) = -A/(1 - b_1 z^{-1} - b_2 z^{-2} \dots, -b_m z^{-m})$$

where A is the filter gain, and the b's are the multiplier coefficients. A flow diagram of the recursive filter 20 is shown in FIG. 2. The random noise signal S(n) produces an amplitude modulated signal which changes its amplitude from one level to another at the same rate as that at which the original analog signal was sampled. The random noise signal is multiplied in multiplier 22 by a factor A, where A is determined from the normalization of the autocorrelation function as explained earlier and is constant during each block. The output of multiplier 22 is applied to an adder 23 which provides the output y(n) (n=total number of samples of the signal being simulated) of the recursive filter 20 and also provides y(n) to the first delay stage 24' having a delay which is equal to the intersample interval. The output y(n−1) of the delay unit 24' is transferred to a second delay unit 24'' and also is provided to a multiplier 25' which multiplies the output y(n−1) by the coefficient $b_1$ obtained from the covariance matrix. The output of multiplier 25' is provided as an input to the adder 23. The process of delaying the earlier sampled values y(n−2), . . . , y(n−m) continues in the remaining delay units 24 whose outputs are respectively multiplied by the coefficients $b_2$, $b_3$, $b_4$ . . . $b_m$ (constant during each block) in multipliers 25 whose outputs are in turn applied as inputs to adder 23. The transfer function of the recursive filter 20 of FIG. 2 is that given by the transfer function of the preceding equation. The synthesized audio signature is then evaluated first aurally for subjective similarity and then by using a spectrogram to compare with the original signature the variation of power density in frequency with time. If either evaluation indicates that additional fidelity may be desirable, then the block size, sample frequency, number of coefficients and time alignment of the block boundaries with the selected signature are reselected and another signature is produced for determination of acceptance. The procedure proceeds iteratively as shown in the flow chart of FIG. 1A until an acceptable synthesized signature is produced by the filter. In this iterative process, the sample frequency which always exceeds the Nyquist sample frequency is adjusted to select a different portion of the autocorrelation function of the sampled signature for inclusion in the covariance matrix. The block size and the time alignment are selected to align the variations in the analog signature characteristics with the block boundaries so that coefficient generation occurs over intervals when the signature spectrum is quasi-stationary. The number of coefficients is chosen to be the minimum required to produce essentially all of the prediction error reduction as indicated by the residuals of the iterations.

Figure 3:
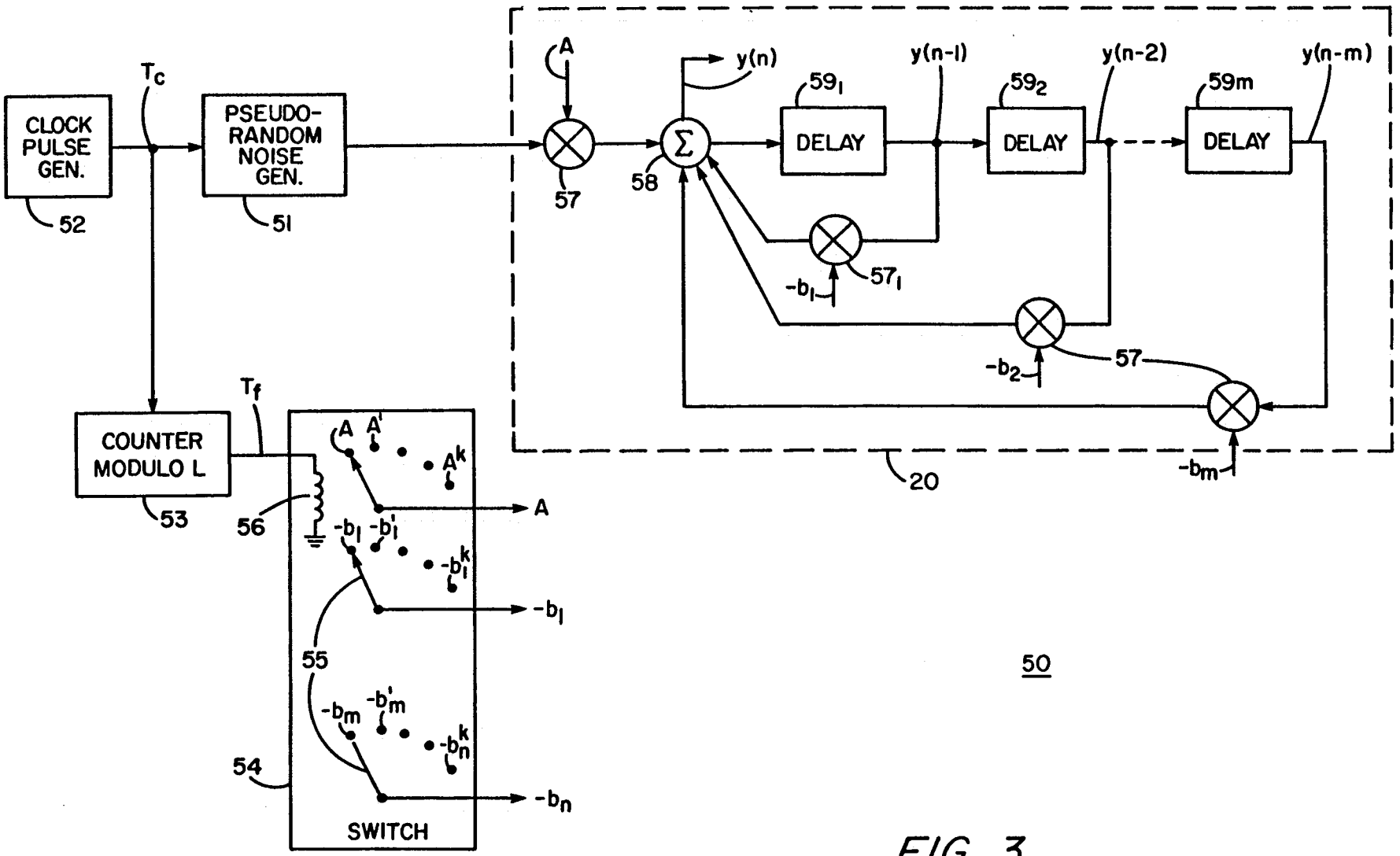
FIG. 3 is an analog representation of an embodiment of the synthesizer of this invention.

Referring now to FIG. 3, there is shown an analog representation of a circuit for the implementation of the synthesizer of this invention. The analog synthesizer 50 comprises a pseudo-random noise generator 51 which produces an analog output signal having a value between zero and one which changes with every clock pulse input, the clock pulses having a period $T_c$ which is the same period as that at which the original signal 10 was sampled. The clock pulses are provided by clock pulse generator 52 which also provides the clock pulses to the counter 53 having a modulo F where F is the number of samples of the analog signal in one block time. The counter 53 provides block pulses whose period $T_f$ is equal to the period of the clock pulses $T_c$ multiplied by the number of samples F, $T_f = T_c \cdot F$. At the end of each block a pulse having period $T_f$ is applied to the memory 54 to produce a new set of analog numbers $A_1$, $-b_1$, . . . , $-b_m$. The memory 54 is represented as a multi-pole switch having n+1 poles with the switch arms 55 moving by one switch position in response to each energization of the switch coil 56 by the pulse $T_f$. Each set of coefficients appear at a selected position of switch arms 25. As shown in FIG. 2, the initial position of the switch arm provides the set of coefficients A, $-b_1, \ldots, -b_m$. The second switch arm position which would exist as a result of one pulse $T_f$ would provide a different set of coefficients for the second block time; namely, $A', -b_1', \ldots, -b_m'$. The last set of coefficients corresponding to the last block of the sampled input signal is provided by the memory 54 as $A^k, -b_1^k, \ldots, -b_m^k$, where k is the number of blocks The output of the pseudo-random noise generator 51 is provided to a multiplier 57 whose other input during a block time is the amplitude coefficient A. The output of multiplier 57 is provided at one input of the summing circuit 58. The output of the summing circuit 58 is provided as the input to a delay unit $59_1$ whose output is provided to delay unit $59_2$ and to multiplier $57_1$. The other input to multiplier $27_1$ is the coefficient $-b_1$ provided by the memory 54 during the first time block. The output of multiplier $57_1$ is provided at another input to the summing circuit 58. The time delay provided by delay $59_1$ is equal to the interpulse period $T_c$ of the clock pulses provided by generator 52. The circuit 50 has a cascade of delay elements $59_2, \ldots, 59_m$ connected serially to the delay $59_1$. The output of the summer circuit is the desired simulated signal which corresponds to the original signal which is being simulated. This simulated signal is designated as y(n). The output of each delay unit $59_1, 59_2, \ldots, 59_m$ is correspondingly $y(n-1), y(n-2), \ldots, y(n-m)$. The circuit 50 will, therefore, provide an output y(n) in accordance with the equation presented earlier which sounds like the original audio signal which was sampled to provide coefficients b in the manner described earlier and stored in memory 54.

Figure 4:
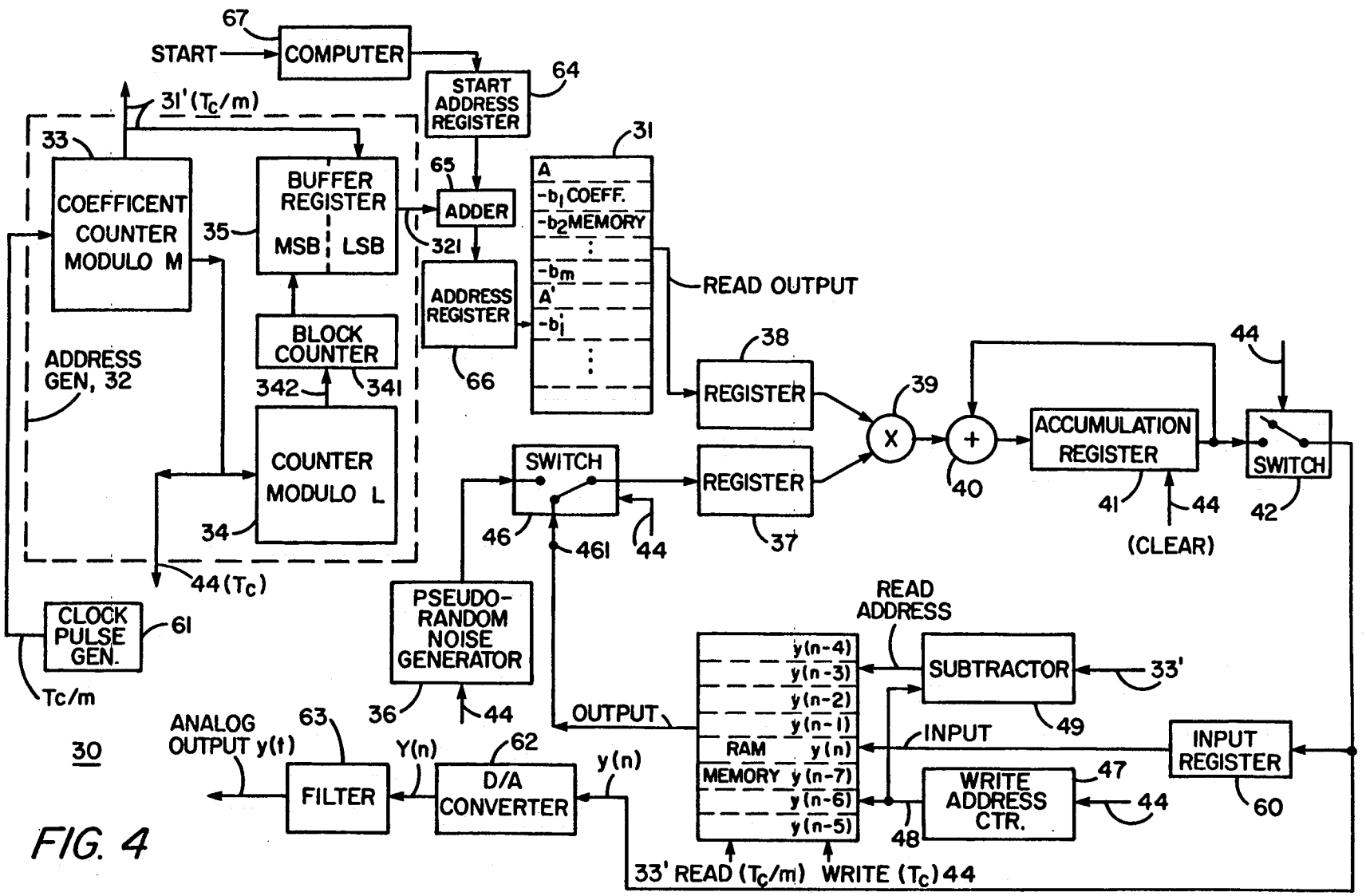
FIG. 4 is a digital implementation of a preferred embodiment of the synthesizer of this invention.

Referring now to the block diagram of FIG. 4 showing an embodiment of the invention, the coefficients which have been computed in the manner detailed in the preceding paragraphs are stored in sequential addresses of a RAM or ROM coefficient memory 31. In the example of the embodiment of this invention, it will be assumed that seven coefficients $b_1$ through $b_7$ of FIG. 2 together with the gain factor A are adequate for the synthesis and are stored in the first eight addresses 0, . . . , 7 of memory 31. Addresses 8, . . . , 15 will contain the coefficients $A', -b_1', \ldots, -b_7'$. Successive groups of eight addresses of RAM 31 have successive groups of coefficients $A, -b_1$ through $-b_7$, (one group for each block of signal data) with the total number of groups of coefficients equaling the number of blocks of the original audio signal which is to be simulated by the synthesizer 30 of FIG. 4. The address generator 32 comprises a counter 33 of modulo m (m=8 for the group of eight addresses), a counter 34 of modulo L (L=number of sample points per block), a block counter 341 responsive to the Lth count of counter 34 and a buffer register 35. Counter 33 has clock input pulses provided by clock pulse generator 61 having a period $T_c/m$ equal to the sampling period of the original audio signal divided by the number of coefficients "m" in a group (m=8 in this example). Counter 34 has input clock pulses having a period $T_c$ obtained from the modulo eight output line 44 of counter 33. Counter 34 is of modulo L, where L is the number of samples per block of input signal. The output pulse of counter 34 at the count of L increments by one the block counter 341. The output count of counter 341 is provided to the more significant bits (MSB) of buffer register 35 which provide the block address to the memory 31. The output count on line 33' of counter 33 is provided as the least significant bits (LSB) of register 35. Therefore, the output address of address generator 32 on line 321 will initially produce (through adder 65 and register 66) the sequential addresses 0, . . . , 7 to the memory 31 repetitively for the number of samples L in the block, followed by the addresses 8, . . . , 15, repeated L times, etc. Therefore, the memory 31 output will be a group of sequential coefficients $A, -b_1, \ldots, -b_m$ at a period $T_c/8$ (for addresses 1 through 8) repeated L times because of the modulo L of counter 34. Block counter 341 which is incremented by one changes the MSB of register 35 so that the addresses 8, . . . , 15 of memory 31 provide the next group of coefficients $A', -b'_1, \ldots, -b'_m$ repeated L times also. This process of providing successive groups of coefficients to synthesize blocks of a signal continues until the memory 31 addresses contain no coefficients.

The pseudo-random noise generator 36 produces a 16-bit word for every 16-bit coefficient provided by memory 31. The word produced by noise generator 36 is stored in a 16-bit register 37. The memory 31 also produces the coefficients as 16-bit digital words and stores the words in register 38. Registers 37 and 38 provide digital inputs to multiplier 39 which provides a 32-bit output word to adder 40. Adder 40 provides an input to accumulator register 41 whose output is provided as a second input to adder 40 and whose output is provided also as an input to switch 42. Switch 42 is open except when closed in response to a pulse on line 44 provided by the modulo m output of counter 33 to the random access memory 45. The counter 33 of modulo 8 provides clock pulses $T_c$ on line 44 as an input to counter 47 which increments a write address to memory 45 at a time such that the switch 42 provides the output y(n) as an input to memory 45. Switch 46 is also responsive to clock pulses at the period T provided by counter 33 on line 44. Closing of switch 46 by a pulse on line 44 allows the 16-bit number from random number generator 36 to be provided to the register 37 at that time as stated earlier. Since pulses in lines 44 only occur during the eighth count of counter 33, during the remaining seven other outputs of counter 33, switch 46 has an input 461 connected to the output of memory 45. The write address provided by counter 47 at output 48 is provided as one input to subtract circuit 49. The other input to subtractor 49 is the output count from counter 33 on line 33'. The read address is provided at the time that the switch 46 input line 47 is providing a signal corresponding to that address from memory 45 to the register 37.

In operation, the circuit of FIG. 4 provides a newly calculated value of y(n) at intervals corresponding to the original sampling period $T_c$. Initially, the RAM 31 generates an amplitude coefficient A which is stored in register 38 and multiplied in multiplier 39 by the output x(n) of the random noise generator 38 provided to register 37 through closed switch 46. The product $A \cdot x(n)$ is stored in accumulation register 41. Switch 42 is open and no output appears to be read into memory 45 through its input register 60. At the next occurrence of clock pulse $T_c$, the switch 46 connects register 37 with the output of memory 45. Subtractor circuit 49 has an input address 48 and an input address 33' which causes the next read address presented to memory 45 to be the address next preceding that at which the output y(n) has been written in by write address counter 47. This address will cause the value $y(n-1)$ to be read out to the register 37. At the same time, the address generator 32 is indexed to the second address of memory 31 and the value $-b_1$ will be read out and provided to register 38.

The resulting product provided by multiplier 39, $-b_1y(n-1)$, is added in adder 40 to the previously stored value Ax(n) in register 41 and the sum $(Ax(n)-b_1y(n-1))$ is then stored in accumulation register 41. The next timing pulse $T_c/m$ causes the read address provided to memory 45 to be decremented by one and provide the output y(n−2) to the register 37 through switch 46. At the same time, the address provided to memory 31 is incremented by one to provide the coefficient $-b_2$ to register 38. The contents of the registers 37, 38 are multiplied in multiplier 39 to provide $-b_2y(n-2)$ which is added in adder 40 to the exiting contents $(Ax(n)-b_1y(n-1))$ of accumulation register 41 and the result $(Ax(n)-b_1y(n-1)-b_2y(n-2))$ is then stored in register 41. This process continues until the last coefficient $b_7$ at the eighth address of memory 31 is provided to register 38 and the contents of memory 45 at the address containing y(n−7) are multiplied, added and accumulated in register 41 which is then cleared and read out through switch 42 by a pulse on line 44 to input register 60. Register 60 then contains the output y(n+1) (which becomes the new value of y(n)) which is written into the next sequential address of memory 45 inasmuch as the write address counter 47 responsive to a pulse at the rate $1/T_c$ on line 44 from counter 33 has caused the write address on line 48 to be incremented by one. When the new value of y(n) appears at the output of register 41, switch 42 is caused to close by a pulse on line 44 to thereby provide a new y(n) output and to provide this new value as the input to the memory 45 at the incremented address. The output y(n) of switch 42 is in digital form and is converted to an analog signal Y(n) in digital-to-analog converter 62. Signal Y(n) is smoothed in filter 63 to remove the sampling frequency components, centered at frequencies $1/T_c$ and multiples thereof, and to thereby provide the synthesized analog signal y(t) that is desired corresponding to the blocks of coefficients selected by the initial address provided by start address register 64 which is added in adder 65 to the output of buffer register 35 and stored in register 66 before being provided to coefficient memory 31. The computer 67 is programmed to provide one or a series of start addresses at predetermined time intervals to register 64 in response to a START command to thereby produce one or a series of timed, different synthesized audio output signals y(t), each corresponding to a different start address.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A method for providing a synthesized transient signal which is a replica of an original mechanically produced transient signal comprising the steps of:

sampling said original signal to provide sampled signals at a sample rate;

grouping consecutive sampled signals into blocks;

determining the autocorrelation coefficients for the sampled signals in each block;

determining the covariance matrix coefficients of each successive block of said sampled signal from the autocorrelation coefficients of each corresponding block;

applying a pseudo-random digital noise signal which changes at the sample rate to the input of a recursive filter;

applying the coefficients derived from the covariance matrix as multiplying factors to the respective multipliers of said recursive filter for a time equal to that of a block of said sampled signal;

changing the covariance matrix derived coefficients successively applied to said recursive filter to the values corresponding to the time of each said successive block of sampled signal; and obtaining the output of said recursive filter to provide a synthesized transient signal which reproduces the sound of said original transient signal.

2. Apparatus for providing a synthesized transient signal replica of an original transient signal comprising:

means for producing clock pulses;

means for producing a pseudo-random noise signal in response to said clock pulses;

means for determining a predetermined number of clock pulses;

means for providing sets of covariance matrix derived coefficients derived from an original transient signal;

a recursive filter having a plurality of delay means and a plurality of multipliers each connected to the output of a different delay means of said filter, an additional multiplier connected to the input of said filter, an adder to which all of said multipliers are connected;

said recursive filter having an input connected to said means producing a pseudo-random noise signal;

said coefficient providing means providing to each of said plurality of multipliers individual covariance matrix derived coefficients during each set;

means for providing to said additional multiplier an amplitude coefficient during each set;

means for changing each set of coefficients in response to said predetermined number of clock pulses; and an output of said recursive filter providing said synthesized transient signal.

3. The apparatus of claim 2 wherein:

said clock pulses have a fixed period between pulses, said period corresponding to the sampling period of the transient signal being synthesized from which said covariance matrix coefficients were derived.

4. Apparatus for providing a synthesized transient signal replica of an original transient signal which original signal is sampled and whose autocorrelation coefficients at said sample time intervals result in covariance matrix coefficients for blocks of sequential sampled original transient signal comprising:

a clock pulse generator;

a pseudo-random noise generator responsive to said clock pulse generator producing a random amplitude signal at each clock pulse;

a first memory containing a plurality of sets of a normalization factor and covariance matrix derived coefficients in a like plurality of sets of addresses of said memory;

each set of a normalization factor and matrix derived coefficients corresponding to a corresponding block of sampled original transient signals;

means for repetitively providing sequentially each factor and coefficient of successive sets;

a second memory providing successive values of y(n) at successive addresses;

means for multiplying in sequence said random amplitude signal with said factor and multiplying the first one of said sequence of matrix derived coefficients with the values of y(n) in reverse order of succession in which y(n) values are stored in said second memory to provide a succession of products;

means for adding said products of each sequence of coefficients to provide a value y(n) for each sequence;

said for means repetitively providing said sets of coefficients resulting in a corresponding number of values of y(n);

said means for repetitively providing said sets of coefficients providing the same set of coefficients for the same number of times as said original signal is sampled in each time block at which time the next successive set of coefficients is repetitively provided; and means for providing said value of y(n) as an output signal.

5. Apparatus for providing a synthesized transient signal from a sampled original transient signal whose autocorrelation coefficients at sample time intervals over a fixed duration of sample time intervals result in covariance matrix derived coefficients for each time block comprising:

a clock pulse generator;

a pseudo-random noise generator responsive to said clock pulse generator to produce a random amplitude signal at each clock pulse;

means for repetitively providing a plurality of sets of said covariance matrix derived coefficients for a fixed number of times corresponding to the number of samples in each time block;

means for multiplying each coefficient of said sets of coefficients with one of said random input signals and successive earlier values of y(n) to provide corresponding products;

means for adding said corresponding products to provide a value of y(n) for each set of coefficients;

said means for repetitively providing said sets of coefficients resulting in a corresponding number of successive values of y(n); and means for providing said value of y(n) as an output signal.

6. A method of synthesizing the sound associated with a transient signal comprising the steps of:

(a) taking a plurality of samples of each block of different sequential blocks of the transient signal;

(b) generating a corresponding sequence of time varying coefficients for a filter;

(c) applying noise to the input of the filter as the coefficients of such filter are sequentially varied in accordance with the corresponding sequence of generated time varying coefficients to produce an output signal;

(d) comparing the output signal with the transient signal; and (e) modifying the sequence of time varying coefficients for the filter and sequentially repeating steps (c), (d), and (e) iteratively until the output signal is a substantial replication of transient signal.

7. The method of claim 6 wherein said modifying the sequence of time varying coefficients comprises changing the time duration of the blocks of said sequential blocks.

8. The method of claim 6 wherein said modifying the sequence of time varying coefficients comprises:

said taking of a plurality of samples of each block has a sampling frequency; and changing the sampling frequency.

9. The method of claim 6 wherein said modifying the sequence of time varying coefficients comprises:

changing the number of filter coefficients generated per block.

10. The method of claim 6 wherein said modifying the sequence of time varying coefficients comprises changing the time alignment of said sequential blocks with respect to said transient signal.

* * * * *